US008007888B2

(12) United States Patent
Sangouard et al.

(10) Patent No.: US 8,007,888 B2
(45) Date of Patent: Aug. 30, 2011

(54) FIRE PROTECTION BLANKET AND ASSOCIATED METHOD

(75) Inventors: Gilles Sangouard, Simandres (FR); Vincent Raillard, Bassens (FR)

(73) Assignee: Freyssinet, Velizy Villacoublay (FR)

( * ) Notice: Subject to any disclaimer, the term of this patent is extended or adjusted under 35 U.S.C. 154(b) by 154 days.

(21) Appl. No.: 12/340,078

(22) Filed: Dec. 19, 2008

(65) Prior Publication Data

US 2009/0280287 A1 Nov. 12, 2009

(30) Foreign Application Priority Data

Dec. 19, 2007 (FR) ..... 07 60044

(51) Int. Cl.
*A62C 8/06* (2006.01)

(52) U.S. Cl. ..... 428/76; 442/380; 442/393; 442/389; 442/391

(58) Field of Classification Search ..... 428/76; 442/380, 393, 391, 389
See application file for complete search history.

(56) References Cited

U.S. PATENT DOCUMENTS

| | | | |
|---|---|---|---|
| 5,284,700 | A | 2/1994 | Strauss et al. |
| 6,147,015 | A | 11/2000 | Bureau |
| 2006/0213138 | A1 | 9/2006 | Milani et al. |

FOREIGN PATENT DOCUMENTS

| | | | |
|---|---|---|---|
| GB | 2039829 | A | 8/1980 |
| GB | 2424260 | A | 9/2006 |

*Primary Examiner* — Alexander Thomas
(74) *Attorney, Agent, or Firm* — McKenna Long & Aldridge LLP

(57) ABSTRACT

A fire protection blanket comprising: at least two fibrous subassemblies arranged substantially parallel to a principal surface of the blanket in which each fibrous subassembly comprises at least two mineral fiber wool layers, substantially parallel to the principal surface of the blanket, separated by at least one mineral fiber fabric and in which refractory particles are arranged inside at least one mineral fiber wool layer; at least one layer of refractory adhesive attaching the fibrous subassemblies to each other; and a covering comprising a mineral fiber fabric impregnated with a fire-resistant silicone and enclosing all of the fibrous subassemblies.

14 Claims, 2 Drawing Sheets

FIRE PROTECTION BLANKET AND ASSOCIATED METHOD

CROSS REFERENCE TO RELATED APPLICATIONS

This application claims the right of priority to French Patent Application No. 07 60044, filed in France on Dec. 19, 2007, the entire contents of which is incorporated herein by reference.

BACKGROUND OF THE INVENTION

The subject of the present invention is a fire protection blanket, in particular for firestop applications.

By "blanket" is understood a flexible device which is easy to handle, substantially flat in shape, where the thickness is substantially less, even by at least a factor of 5, even for example by at least a factor of 10 than each of the other dimensions.

In general such a blanket is substantially in the form of a parallelepiped. A surface of the blanket or a constituent layer thereof which is perpendicular to the direction of thickness is called the "principal surface". This principal surface is generally rectangular, but it can also be trapezoidal, have one or more curves, or have any form suitable for protecting a given device against heat propagation, in particular in the case of fire.

Such a blanket is for example used to protect cables and/or ducts in a cable run or means of conveyance of fluid. By "means of conveyance of fluid" is understood any line or carrier of a fluid in the wide sense, gas or liquid.

The cables or ducts generally contain wires or fibres such as for example electrical power or signalling wires, coaxial cables or optical fibres.

It is in fact very important, even essential, to be able to protect cables or ducts or means of conveyance of fluid during a fire, for example at least to protect the cables containing wires connected to sensors, particularly fire sensors, or to control means, particularly with a view to extinguishing a fire or triggering an alarm or safety device.

A particular case of a device where rigorous fire protection must be provided relates to inspection chambers. Such chambers are cavities making it possible to gain access to embedded cable runs. They are for example distributed at regular intervals over long distances to allow initially for the cables to be pulled through and subsequently for their inspection.

Generally, inspection chambers are in the form of a parallelepiped, comprising a removable face and two faces suitable for openings to be made capable of allowing cables, ducts or means of conveyance of fluid to pass through. Such inspection chambers are in particular installed embedded in tunnels, and are substantially flush with the level of the carriageway. Safety requirements in the tunnels are particularly high and there is a need to find improved means of fire protection, particularly for this type of application.

SUMMARY OF THE INVENTION

The present invention relates to a fire protection blanket capable of being easily handled, while offering improved fire protection.

The invention therefore proposes a fire protection blanket comprising:

at least two fibrous subassemblies arranged substantially parallel to a principal surface of the blanket in which each fibrous subassembly comprises at least two mineral fibre wool layers, substantially parallel to the principal surface of the blanket, separated by at least one mineral fibre fabric and in which refractory particles are arranged inside at least one mineral fibre wool layer;

at least one layer of refractory adhesive attaching the fibrous subassemblies to each other; and a covering comprising a mineral fibre fabric impregnated with fire retardant silicone and enclosing all of the fibrous subassemblies.

Due to the configuration of the blanket, it is possible of obtain a blanket which is remarkably effective in terms of fire protection and which is easily handled. Such a blanket can in fact be manufactured on an industrial site and transported for installation at a desired location. Moreover, it can easily be removed, for example in order to inspect an installation or a device that it protects, and be then replaced without damage while still providing excellent fire protection.

According to various embodiments, which can be combined:

the blanket comprises three fibrous subassemblies, between each of which is arranged at least one layer of refractory adhesive;

each fibrous subassembly comprises three mineral fibre wool layers between each of which is arranged at least one mineral fibre fabric;

the mineral fibres of the mineral fibre wool layers are refractory fibres, for example constituted essentially of silica ($SiO_2$), calcium oxide (CaO) and magnesium oxide (MgO);

the mineral fibres of the mineral fibre fabrics are glass fibres, for example of the Verrane type;

the mineral fibres of the covering are glass fibres, for example continuous fibres;

the constituents of each fibrous subassembly are simultaneously needled;

the refractory glue is constituted of alumino-silicate components;

the refractory particles are metasilicates; and handles are arranged on a surface of the covering parallel to the principal surface of the blanket.

The invention also relates to a method of manufacture of a fire protection blanket comprising the following steps:

a) manufacture of at least two fibrous subassemblies comprising the sub-steps:

a1) arranging a mineral fibre wool layer substantially horizontally;

a2) arranging refractory particles on a principal surface of the mineral fibre wool layer in step a1);

a3) arranging at least one mineral fibre fabric on a principal surface of the mineral fibre wool layer;

a4) arranging a mineral fibre wool layer on the mineral fibre wool layer covered with the refractory particles in step a2) and the fabric in step a3);

a5) optionally, repeating steps a2) to a4) in order to obtain the desired number of layers of mineral fibre wool layers;

a6) needling the intermediate product resulting from steps a1) to a5) to constitute a fibrous subassembly;

b) superimposing and assembling at least two fibrous subassemblies by placing a layer of refractory adhesive between them; and c) arranging a covering, comprising a mineral fibre fabric impregnated with a fire-retardant silicone, around the intermediate product obtained after step b).

Such a succession of steps makes it possible to obtain advantageously a fire protection blanket having excellent fire-resistance properties and which advantageously retards a temperature increase of a device or an installation that it is intended to protect.

It should be noted that the above characteristics relating to the constituents of the blanket according to the invention are transferable to the materials used in the present method.

The present invention also relates to an inspection chamber comprising walls, including at least one removable wall, delimiting a space for receiving cables and/or means for conveying fluid, generally passing through the inspection chamber, which comprises a fire protection blanket as described above or obtained according to the above method, and in which the blanket is arranged between the space for receiving cables and/or means of conveying fluid and the removable wall.

Such an inspection chamber is thus advantageously protected against fire and can be installed satisfactorily in tunnels where it meets the safety requirements specific to such installations.

BRIEF DESCRIPTION OF THE DRAWINGS

Other features and advantages of the present invention will become apparent from the following description of non-limitative embodiments, with reference to the attached drawings, in which.

For reasons of clarity, the dimensions of the various elements shown on these figures are not necessarily proportional to their actual dimensions. In these figures, identical references correspond to identical elements.

DESCRIPTION OF PREFERRED EMBODIMENTS

Figure 1:
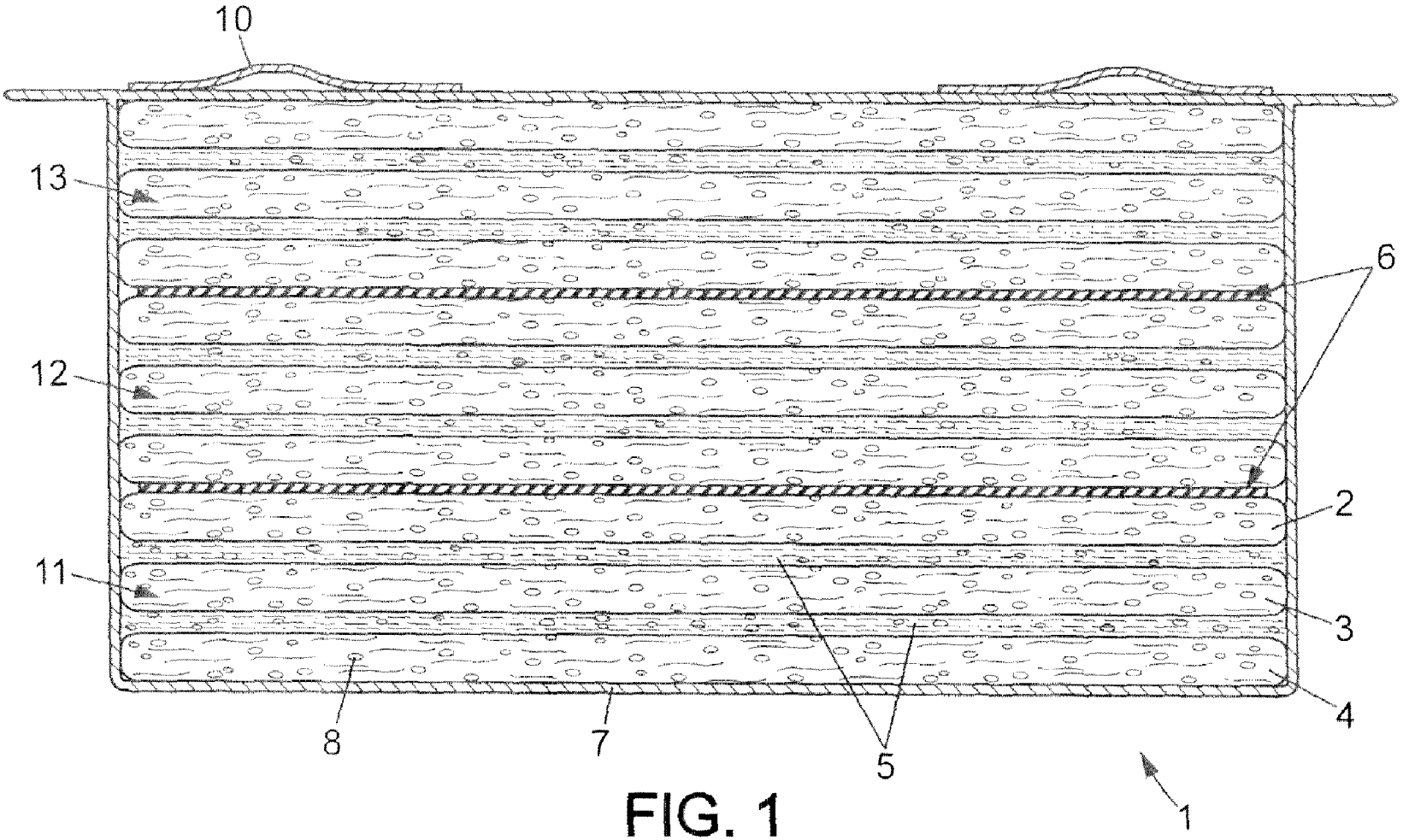
FIG. 1 shows a diagrammatic cross section of a blanket according to the invention.

FIG. 1 illustrates an example fire protection blanket 1 according to the invention, viewed diagrammatically in cross section. The blanket 1 comprises three identical superimposed fibrous subassemblies 11, 12, 13, arranged parallel to a principal surface of the blanket 1.

Each fibrous subassembly is constituted by three superimposed mineral fibre wool layers 2, 3, 4 arranged parallel to the principal surface of the blanket 1.

In each fibrous subassembly, 11, 12, 13, the mineral fibre wool layers are separated from each other, 4 and 3, 3 and 2, by at least one mineral fibre fabric 5. It is possible of arrange a single layer of fabric or to superimpose several between two mineral fibre wool layers.

Refractory particles 8, in particular metasilicates, are dispersed substantially evenly within each fibrous subassembly 11, 12, 13.

A means allowing for substantially even dispersal of the refractory particles 8 to be obtained within each fibrous subassembly consists of arranging refractory particles on the surface between two mineral fibre wool layers, 4 and 3, 3 and 2 then needling the whole. The movement of the needles makes it possible to exert pressure on these refractory particles and to ensure their dispersal within the mineral fibre wool layers, 2, 3, 4.

Refractory particles can also be arranged in contact with the fabrics 5 separating the mineral fibre wool layers or between folds of fabrics 5 if a plurality of mineral fibre fabrics are superimposed between the mineral fibre wool layers.

The fibrous subassemblies 11, 12, 13 are superimposed and firmly attached to each other by a layer of refractory adhesive 6 arranged substantially over the whole contact surface between two fibrous assemblies, 11 and 12, 12 and 13.

A covering 7 surrounds the assembly and forms the principal surfaces of the blanket, as well as its lateral surfaces. The covering 7 is constituted of mineral fibres impregnated with a fire-retardant silicone.

Preferably, this covering is sealed. This covering can comprise free ends extending beyond the principal surfaces of the fibrous subassembly, for example to ensure a bond between a wall and the blanket 1.

The blanket shown further comprises handles 10 arranged on a principal surface of the covering 7 which allow easy handling of the blanket. It is thus possible to put it in place easily and if necessary remove it, in particular for an inspection after which the blanket is returned to its place.

Figure 2:
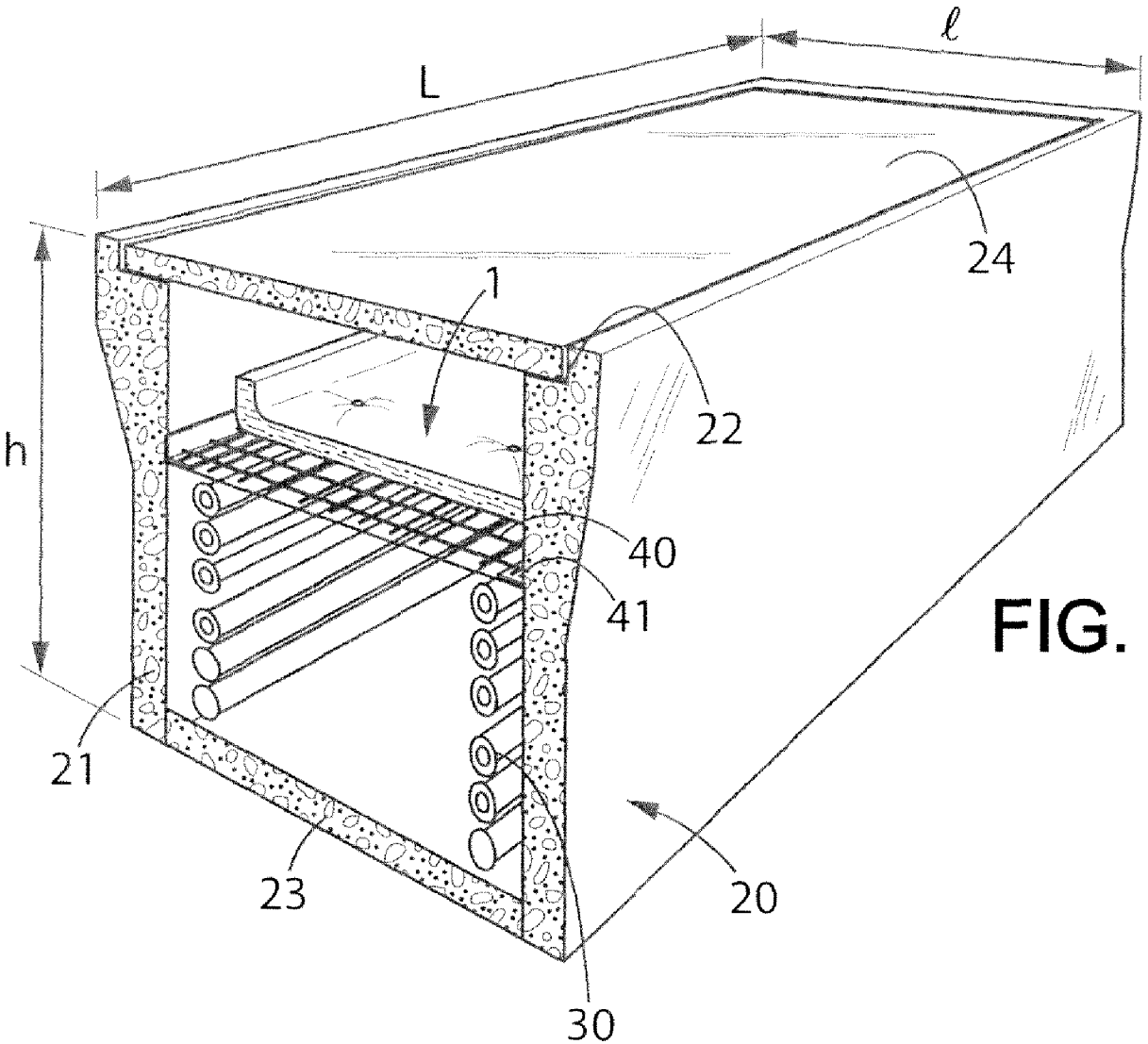
FIG. 2 shows an inspection chamber comprising such a blanket.

FIG. 2 shows a diagrammatic perspective view in which a blanket 1 according to the invention is arranged in an inspection chamber 20.

The inspection chamber 20 is substantially a parallelepipedic rectangle with external dimensions l×w×h. It comprises two substantially vertical walls 21, a base 23, a removable wall 24 forming a cover and two lateral walls (not shown) comprising openings to allow the passage of a plurality of cables, ducts or means of fluid conveyance 30.

Generally, such a lateral wall comprises zones of reduced thickness, in particular circular zones, which can easily be removed, for example with a hammer and chisel, in order to provide an opening in the place where is desired to pass the cable and/or ducts and/or a means of fluid conveyance.

In the inspection chamber 20, a support zone 22 has been arranged in the walls 21 in order to receive the cover 24 and hold it flush.

By way of example, an inspection chamber of this type can have the following external dimensions: l=1.63 m, w=0.77 m, h=0.68 m.

By way of example, the cables pass through the inspection chamber 20 and are electrical power cables, cables allowing sensors to be connected to a control system, installation control cables, coaxial cables or optical fibres.

The lateral walls 21 and the base are generally made of concrete. The cover 24 is for example made of reinforced concrete or cast iron.

In a manner known per se, such an inspection chamber can be embedded, and arranged for example in such a way that the cover 24 is flush with a floor, in particular level with a roadway or pavement.

A fire protection blanket 1 according to the invention is arranged between the cables, ducts or means of conveyance of fluid 30 and the cover 24.

The blanket 1 can be arranged directly and placed above the cables, ducts or other means of conveyance of fluid.

It is also possible to provide a grille 40 on which the blanket 1 is placed. The grille 40 can be made of metal and rest on supports, for example angle brackets 41 fixed to the inspection chamber and situated between the cables, ducts and other means of conveyance of fluid and the cover 24.

Fire protection blankets according to FIG. 1 have been manufactured and tested in conditions representing a fire in the configuration in FIG. 2.

The mineral wool used is constituted essentially of silica ($SiO_2$), calcium oxide (CaO) and magnesium oxide (MgO).

Each mineral fibre wool layer 2, 3, 4 has a thickness of 7 to 8 mm.

The thickness of each fibrous subassembly is approximately 25 mm, so that the total thickness of the blanket is approximately 75 mm.

The mass per unit area of each of the mineral wool layers is approximately 6 to 7 kg/m2.

Metasilicate particles were arranged between the mineral fibre wool layers of each fibrous subassembly at a mass per unit area of 0.8 kg/$m^2$. Each fibrous subassembly was then needled.

A refractory adhesive made up of an alumino-silicate component was arranged between the fibrous subassemblies.

Blankets made in this way were arranged in an inspection chamber as shown in FIG. 2. Power and signalling cables and optical fibres were positioned, and were connected on either side of the inspection chamber to measuring instruments.

The inspection chamber thus constituted was placed in a furnace suitable for the tests representing a fire. Blocks of refractory material were used to partition the side parts of the inspection chamber while leaving the cover free. Instruments were connected to the assembly, in particular using thermocouples.

Two temperature cycles characteristic of a test representing a fire were carried out for each of the configurations. The first temperature cycle follows the standardized development according to the time/temperature curve referenced ISO 834, the second follows the development of a time/temperature graph known to a person skilled in the art called an HCM curve (modified hydrocarbon fire curve).

It was noted that the blanket makes it possible to attain non-degraded operation of the power and signalling cables and optical fibres arranged in the inspection chamber for at least 4 hours for the tests according to the ISO 834 curve and for at least 2 hours for the tests according to the HCM curve.

Such fire resistance levels are remarkable and make it possible to envisage protection compatible with the most recent requirements for use in tunnels, in particular road tunnels.

The invention is not limited to these types of embodiment and must be interpreted in a non-limitative manner, encompassing any equivalent embodiment.

What is claimed is:

1. A fire protection blanket comprising:

at least two fibrous subassemblies arranged substantially parallel to a principal surface of the blanket, in which each fibrous subassembly comprises at least two mineral fibre wool layers, substantially parallel to the principal surface of the blanket, separated by at least one mineral fibre fabric and in which refractory particles are arranged inside at least one mineral fibre wool layer;

at least one layer of refractory adhesive attaching the fibrous subassemblies to each other; and a covering comprising a mineral fibre fabric impregnated with a fire-resistant silicone and enclosing all of the fibrous subassemblies.

2. The fire protection blanket according to claim 1, comprised of three fibrous subassemblies between each of which is arranged at least one layer of refractory adhesive.

3. The fire protection blanket according to claim 1, wherein each fibrous subassembly comprises three mineral fibre wool layers between each of which is arranged at least one mineral fibre fabric.

4. The fire protection blanket according to claim 1, wherein the mineral fibres of the mineral fibre wool layers are refractory fibres.

5. The fire protection blanket according to claim 4, wherein the refractory fibres are constituted essentially of silica ($SiO_2$), calcium oxide (CaO), or magnesium oxide (MgO).

6. The fire protection blanket according to claim 1, wherein the mineral fibres of the mineral fibre fabrics are glass fibres.

7. The fire protection blanket according to claim 1, wherein the mineral fibres of the covering are glass fibres.

8. The fire protection blanket according to claim 7, wherein the glass fibres are continuous glass fibres.

9. The fire protection blanket according to claim 1, wherein the constituents of each fibrous subassembly are simultaneously needled.

10. The fire protection blanket according to claim 1, wherein the refractory adhesive comprises alumino-silicate components.

11. The fire protection blanket according to claim 1, wherein the refractory particles are metasilicates.

12. The fire protection blanket according to claim 1, further comprising handles, wherein the handles are arranged on a surface of the covering parallel to the principal surface of the blanket.

13. An inspection chamber comprising walls including at least one removable wall delimiting a space to receive cables and/or means of conveyance of fluid, and comprising a fire protection blanket according to claim 1, in which the blanket is arranged between the space for receiving cables and/or means of conveyance of fluid and the removable wall.

14. The inspection chamber of claim 13, wherein the inspection chamber is adapted for use in a tunnel.

* * * * *